US008120287B2

(12) United States Patent
Lin et al.

(10) Patent No.: US 8,120,287 B2
(45) Date of Patent: Feb. 21, 2012

(54) HIGH EFFICIENCY POWER SYSTEM FOR A LED DISPLAY SYSTEM

(75) Inventors: Shui-Mu Lin, Longjing Township, Taichung County (TW); Ti-Ti Liu, Taipei (TW); Huan-Chien Yang, Pingtung (TW)

(73) Assignee: Richtek Technology Corp., Hsinchu (TW)

( * ) Notice: Subject to any disclaimer, the term of this patent is extended or adjusted under 35 U.S.C. 154(b) by 351 days.

(21) Appl. No.: 12/585,481

(22) Filed: Sep. 16, 2009

(65) Prior Publication Data

US 2010/0066257 A1 Mar. 18, 2010

(30) Foreign Application Priority Data

Sep. 18, 2008 (TW) ..... 97135861 A

(51) Int. Cl.
*H05B 37/00* (2006.01)

(52) U.S. Cl. ..... 315/312; 315/318; 315/224; 315/294; 315/291; 315/169.1; 345/212; 345/211; 345/204; 345/82; 345/95; 323/280; 323/282; 323/322

(58) Field of Classification Search ..... 315/169.1, 315/169.3, 291, 224, 247, 294, 149, 308, 315/312, 318; 345/1.1, 46, 52, 92, 95, 102, 345/82–84, 204, 211, 212, 214, 903; 323/280–282, 323/290, 318, 322
See application file for complete search history.

(56) References Cited

U.S. PATENT DOCUMENTS

| | | | | |
|---|---|---|---|---|
| 5,184,114 | A * | 2/1993 | Brown | 345/83 |
| 5,990,802 | A * | 11/1999 | Maskeny | 340/815.45 |
| 7,038,594 | B2 * | 5/2006 | Voreis et al. | 340/815.45 |
| 7,116,294 | B2 * | 10/2006 | Stopa | 345/82 |
| 7,123,211 | B2 * | 10/2006 | Nowatzyk | 345/1.1 |
| 7,348,949 | B2 * | 3/2008 | Lee et al. | 345/83 |
| 7,573,209 | B2 * | 8/2009 | Ashdown et al. | 315/307 |
| 7,605,809 | B2 * | 10/2009 | Wey et al. | 345/212 |
| 7,659,672 | B2 * | 2/2010 | Yang | 315/224 |

* cited by examiner

*Primary Examiner* — Haiss Philogene
(74) *Attorney, Agent, or Firm* — Rosenberg, Klein & Lee

(57) ABSTRACT

A LED display system includes multiple LEDs, a power converter to produce a supply voltage for the LEDs, and multiple drivers to drive the LEDs. According to the maximum one of the forward voltages of the LEDs, the drivers provides a feedback signal for the supply voltage control, and the feedback signal is amplified or digitized to reduce the voltage drop in the global power line.

68 Claims, 14 Drawing Sheets

HIGH EFFICIENCY POWER SYSTEM FOR A LED DISPLAY SYSTEM

FIELD OF THE INVENTION

The present invention is related generally to a Light Emitting Diode (LED) display system and, more particularly, to a high efficiency power system for a LED display system.

BACKGROUND OF THE INVENTION

FIG. 1 is a systematic diagram of a conventional LED display system 100 for advertising board applications, which includes an AC/DC converter 102 to provide 5V power for a display panel 104. The display panel 104 includes LED light sources 106, 110 and 114 and drivers 108, 112 and 116 to drive the LED light sources 106, 110 and 114, respectively. Each LED light source 106 includes multiple LEDs 118, each LED light source 110 includes multiple LEDs 120, and each LED light source 114 includes multiple LEDs 122. Both of the LEDs 118 and 120 have a forward voltage of about 2.2V, the LED 122 has a forward voltage of about 3.6V, the AC/DC converter 102 provides a supply voltage of 5V, and therefore, to avoid the residue in the supply voltage makes the LEDs 118, 120 and 122 over heated to be damaged, each of the LEDs 118, 120 and 122 is serially connected with a respective resistor Rc serving a heat sinker to share heat that would be generated by the LEDs 118, 120 and 122.

However, there is a distance between the AC/DC converter 102 and the display panel 104, and thus the resistance Rp of the power lines and the resistance Rg of the ground lines between the AC/DC converter 102 and the display panel 104 will induce a lot of power consumption. In addition, the heat sinker resistors Rc also induce a lot of power consumption. That is, because of the resistances Rp, Rg and Rc, there will be low efficiency and large power consumption in the conventional LED display system 100. Moreover, in the conventional LED display system 100, too much heat induces the degradation of LED performance.

Therefore, it is desired a high efficiency power system for a LED display system.

SUMMARY OF THE INVENTION

According to the present invention, a LED display system includes a plurality of LEDs, a power converter, a plurality of drivers. The plurality of drivers are used to drive the plurality of LEDs, each of the drivers has a plurality of LED pins each of which is connected to a respective one of the plurality of LEDs, and each of the drivers provides a feedback signal at a feedback pin. The power converter is used to convert a DC high voltage to at least a DC low voltage for the plurality of LEDs, and regulate the at least a DC low voltage according to one of the feedback signal.

According to the present invention, a LED display system includes a plurality of LEDs, a power converter, and a plurality of drivers. The power converter converts a DC high voltage to at least a DC low voltage for the plurality of LEDs, the plurality of drivers are used to drive the plurality of LEDs. Each of the drivers has a plurality of LED pins each of which is connected to a respective one of the plurality of LEDs, and each of the drivers receives a first digital signal and provides a second digital signal as the first digital signal of the next driver, and the second digital signal of the last driver is used to regulate the at least a DC low voltage.

According to the present invention, a driver for a LED display system includes a plurality of LED pins, a feedback pin, a minimum voltage selector, and a gain stage. Each of the LED pins is connected to a LED. The minimum voltage selector selects the minimum one of the voltages at the plurality of LED pins, the gain stage generates a feedback signal according to the minimum voltage, and the feedback pin provides the feedback signal to regulate a supply voltages for the LEDs.

According to the present invention, a driver for a LED display system includes a plurality of LED pins, a feedback pin, a plurality of current sources, a maximum voltage selector, and a gain stage. Each of the LED pins is connected to a LED. Each of the plurality of current sources controls a respective one of the driving currents in the LEDs, and has a resistor and a transistor connected between the LED pin it is connected and the resistor, and an operational amplifier having a first input connected to a voltage node, a second input connected to the node between the resistor and transistor, and an output connected to the gate of the transistor. The maximum voltage selector selects the maximum one of the gate voltages of the transistors, the gain stage generates a feedback signal according to the maximum voltage, and the feedback pin provides the feedback signal to regulate a supply voltages for the LEDs.

According to the present invention, a driver for a LED display system includes a plurality of LED pins, a feedback pin to provide a feedback signal, a minimum voltage selector, a gain stage, a current source, a switch connected between the feedback pin and a ground node, and a DC-to-PWM converter. Each of the LED pins is connected to a LED. The minimum voltage selector selects the minimum one of the voltages at the plurality of LED pins, the gain stage generates a DC signal according to the minimum voltage, the current source is connected to the feedback pin, the DC-to-PWM converter converts the DC signal to a pulse width modulation (PWM) signal according to the signal at the feedback pin to switch the switch to modulate the signal at the feedback pin, the feedback signal is used to regulate a supply voltages for the LEDs.

According to the present invention, a driver for a LED display system includes a plurality of LED pins, a feedback pin, a minimum voltage sampler, and a gain stage. Each of the LED pins is connected to a LED. The minimum voltage sampler samples the minimum one of the voltages at the plurality of LED pins, the gain stage generates a feedback signal according to the minimum voltage, and the feedback pin provides the feedback signal to regulate a supply voltage for the LEDs.

According to the present invention, a driver for a LED display system includes a plurality of LED pins, a minimum voltage sampler, a gain stage, two hysteretic comparators, and a logic circuit. Each of the LED pins is connected to a LED. The minimum voltage sampler samples the minimum one of the voltages at the plurality of LED pins, the gain stage generates a first signal according to the minimum voltage, the first hysteretic comparator compares the first signal with a first reference voltage to generate a second signal, the second hysteretic comparator compares the first signal with a second reference voltage to generate a third signal, the logic circuit generates a digital output signal according to the second and third signals and a digital input signal to regulate a supply voltages for the LEDs.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
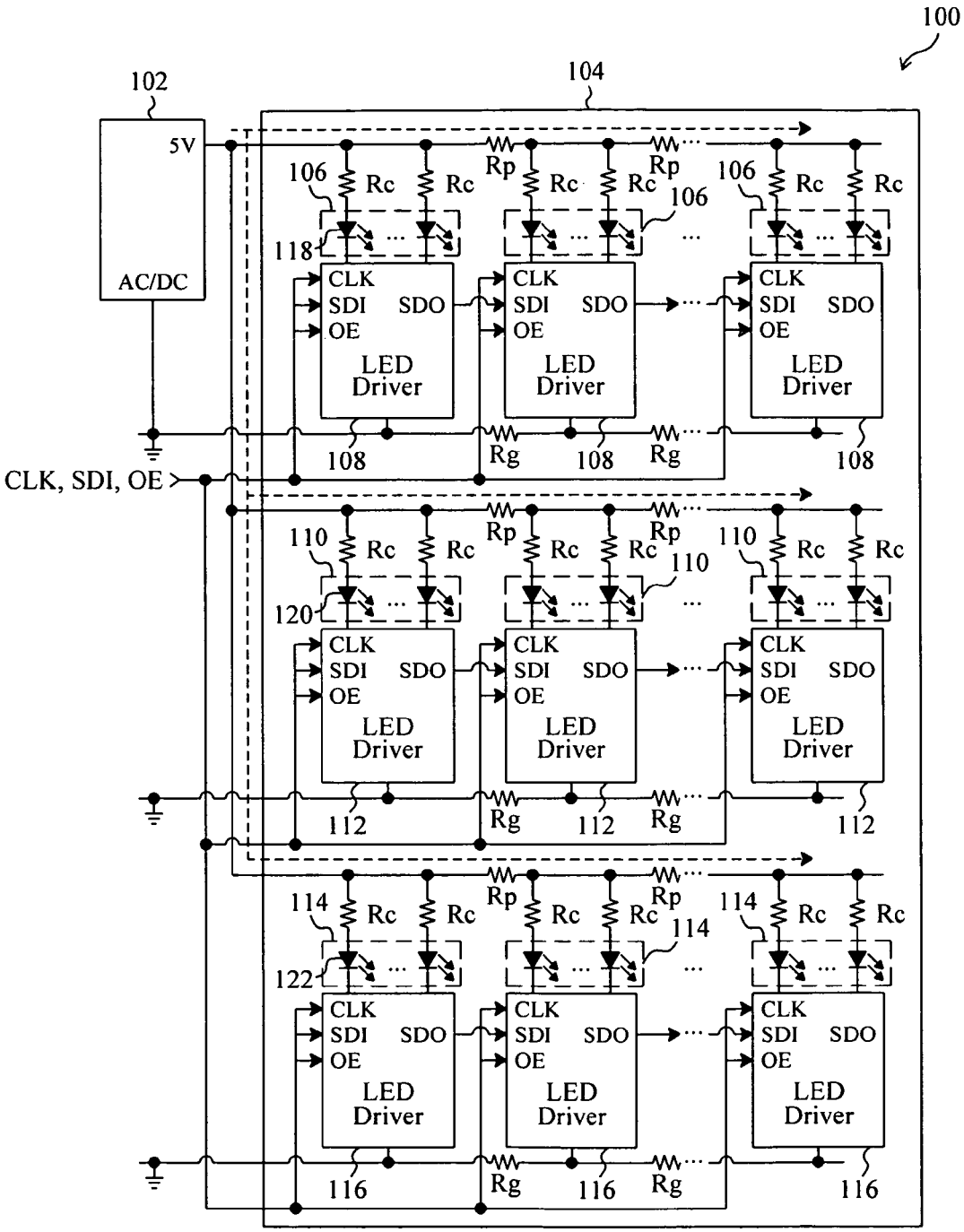
Fig. 1 Prior Art
FIG. 1 is a systematic diagram of a conventional LED display system for advertising board applications.
Figure 2:
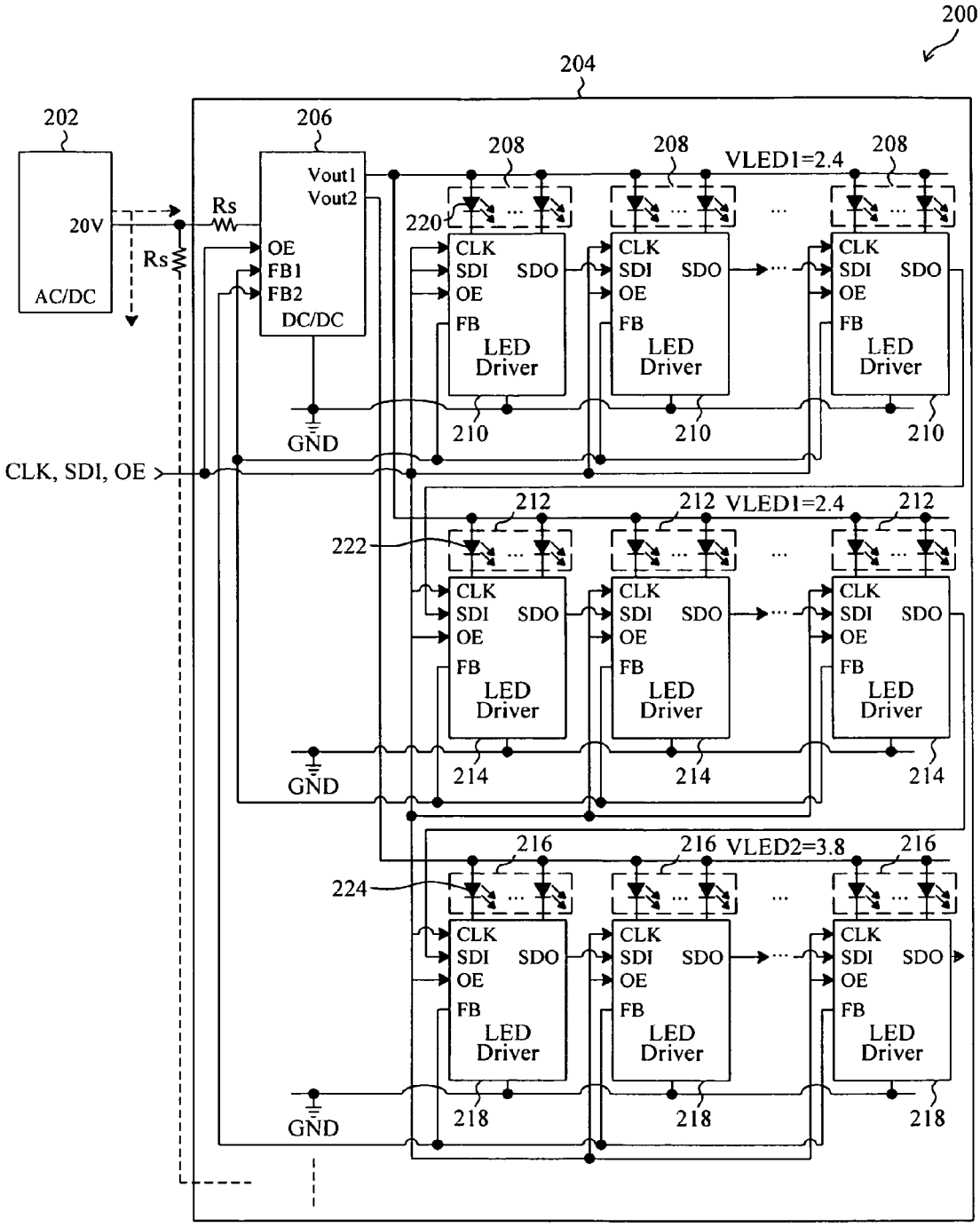
FIG. 2 is a systematic diagram of a LED display system according to the present invention.

FIG. 2 is a systematic diagram of a LED display system 200 according to the present invention, in which an AC/DC converter 202 converts an AC voltage to a DC high voltage of 20V for a display panel 204. Since it is a DC high voltage of 20V provided by the AC/DC converter 202, the currents flowing through the global power lines having the resistance Rs are so small that the power consumed by the line resistance Rs is significantly reduced, and the efficiency of the LED display system 200 is improved. On the display panel 204, a DC/DC converter 206 converts the 20V DC high voltage to 2.4V DC low voltage VLED1 for red and green LED light sources 208 and 212, and 3.8V DC low voltage VLED2 for blue LED light sources 216. Each LED light source 208 includes multiple LEDs 220, each LED light source 212 includes multiple LEDs 222, and each LED light source 216 includes multiple LEDs 224. Multiple LED drivers 210 are employed to drive the LED light sources 208 respectively, multiple LED drivers 214 are employed to drive the LED light sources 212 respectively, and multiple LED drivers 218 are employed to drive the LED light sources 216 respectively. In the LED display system 200, the feedback pins FB of the LED drivers 210 and 214 are all connected to a feedback input pin FB1 of the DC/DC converter 206, and the feedback pins FB of the LED drivers 218 are all connected to a feedback input pin FB2 of the DC/DC converter 206, by which feedback signals FB1 and FB2 are provided for LED supply voltage control, i.e., the DC/DC converter 206 could regulate the supply voltages VLED1 and VLED2 slightly higher than the forward voltages of the LEDs 220, 222 and 224 to reduce heat generation on the LEDs 220, 222 and 224 and thus there is no need of heat sinker resistors. Therefore, the efficiency of the LED display system 200 is further improved, and the total component cost is reduced. Furthermore, with the LED supply voltage control, the LED display system 200 could provide lower supply voltages VLED1 and VLED2 for the LEDs 220, 222 and 224, and thus minimize the impact of LED aging.

Figure 3:
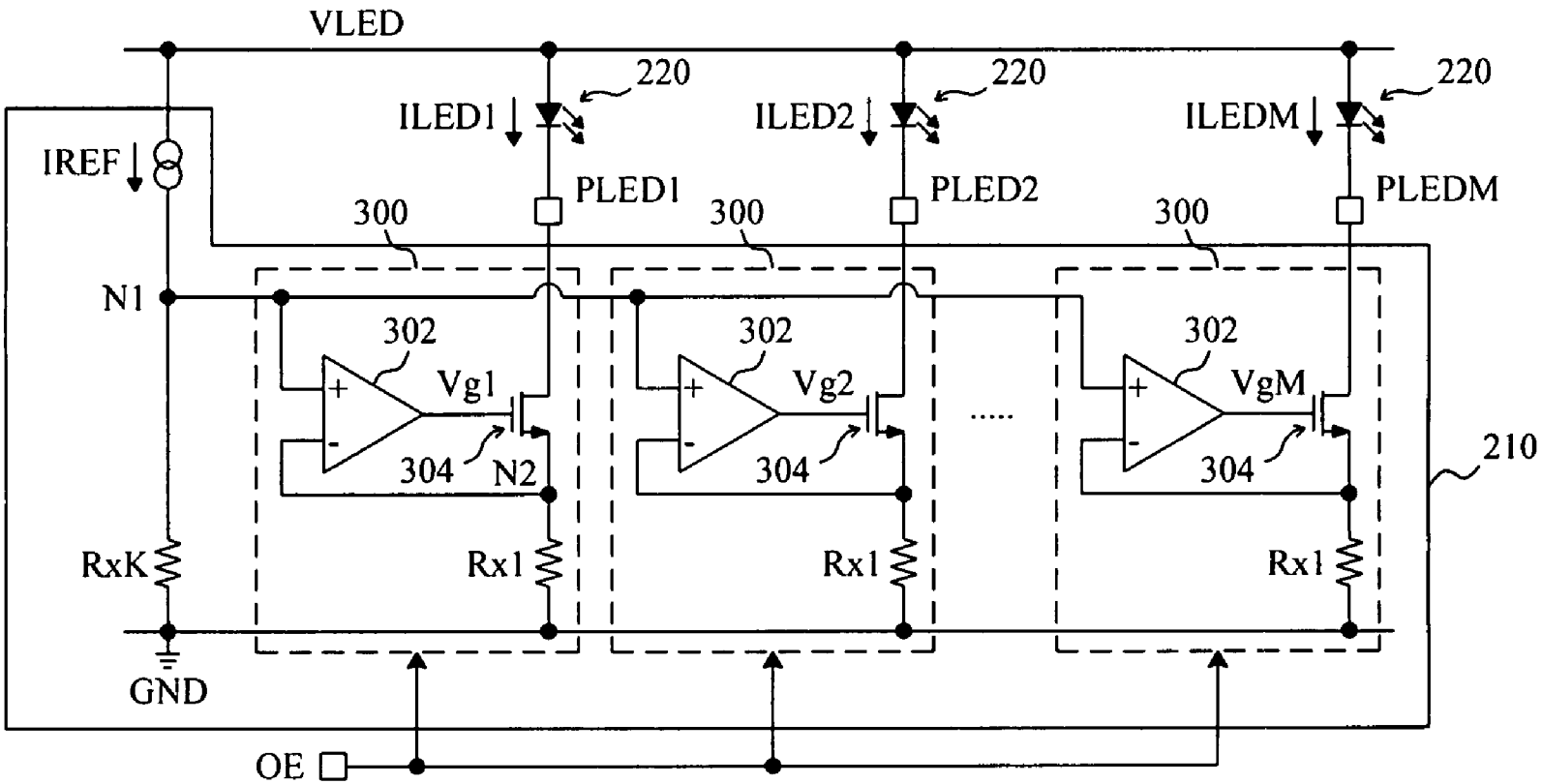
FIG. 3 is a circuit diagram of a first embodiment for the LED driver of FIG. 2.

FIG. 3 is a circuit diagram of a first embodiment for the LED driver 210 of FIG. 2. Referring to FIGS. 2 and 3, in addition to the feedback pin FB, the LED driver 210 further includes a data clock pin CLK to receive a data clock, a data input pin SDI for data input, an output enable pin OE to receive an output enable signal, a data output pin SDO for data output, and LED pins PLED1, PLED2, . . . , PLEDM, each of which is connected to a respective LED 220. In the LED driver 210, multiple current sources 300 are connected to the LED pins PLED1-PLEDM to control the driving currents ILED1, ILED2, . . . , ILEDM flowing through the LEDs 220, respectively. The output enable signal received from the output enable pin OE determines to turn on or turn off the current sources 300. Each current source 300 includes a transistor 304 and a resistor Rx1 serially connected between its LED pin PLEDj (j=1, 2, . . . , M) and a ground node GND, and an operational amplifier 302 having a non-inverting input connected to a node N1, an inverting input connected to a node N2, and an output connected to the gate of the transistor 304.

Figure 4:
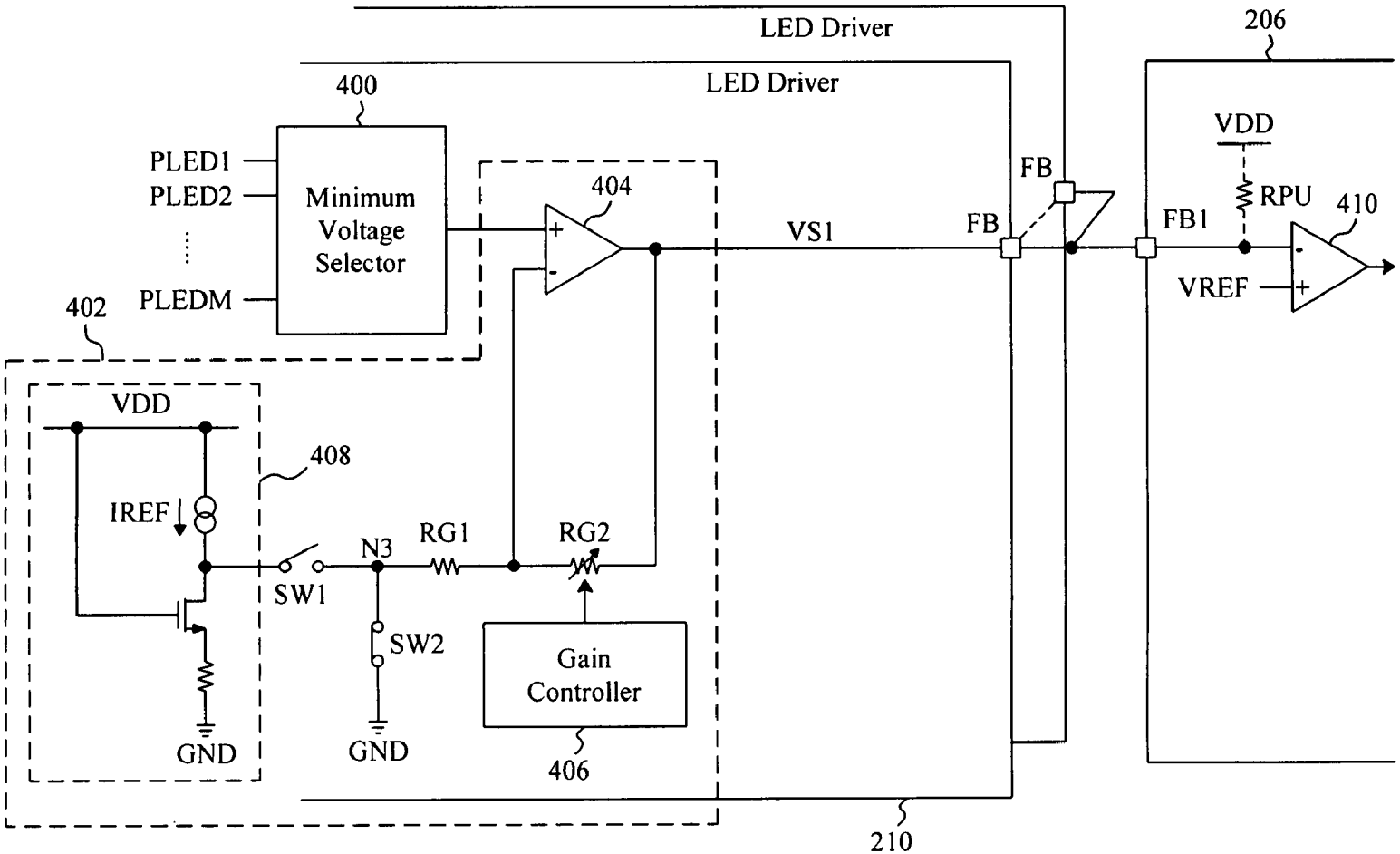
FIG. 4 is a circuit diagram of a first embodiment for the feedback mechanism of the LED driver shown in FIG. 3.
Figure 5:
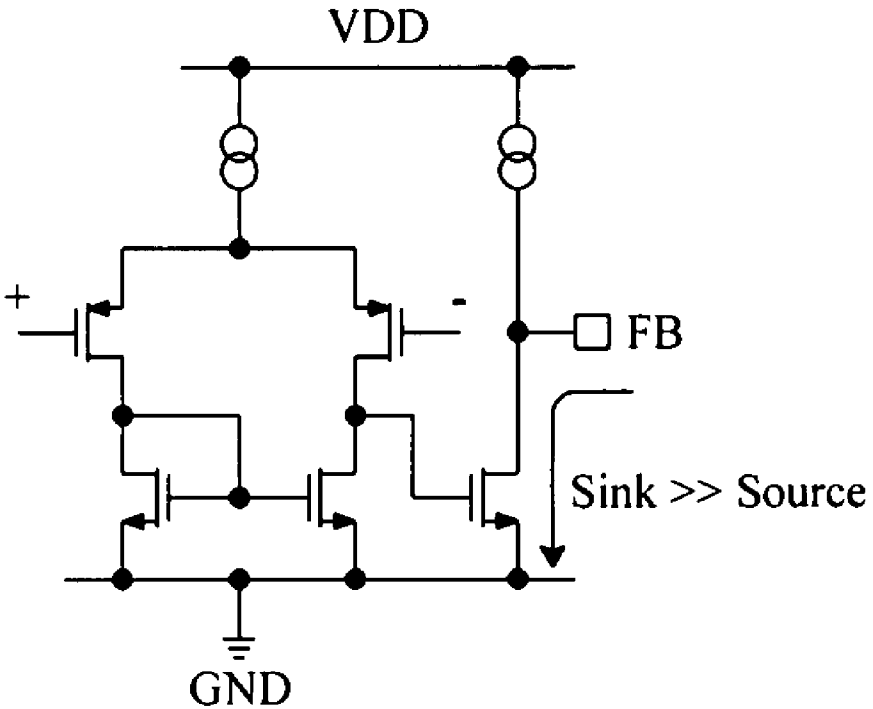
FIG. 5 is a circuit diagram of an embodiment for the buffer shown in FIG. 4.

FIG. 4 is a circuit diagram of a first embodiment for the feedback mechanism of the LED driver 210 shown in FIG. 3, which includes a minimum voltage selector 400 to monitor the voltages at the LED pins PLED1-PLEDM. Referring to FIG. 3, since a same supply voltage VLED is provided for all the LEDs 220, for any LED pin PLEDj, the voltage thereon will be related to the forward voltage of the LED 220 connected thereto. In further detail, the lower the voltage at the LED pin PLEDj is, the greater the forward voltage of the LED 220 connected to the LED pin PLEDj is. Referring to FIG. 4, the minimum voltage selector 400 selects the minimum one from the voltages at the LED pins PLED1-PLEDM to provide for a gain stage 402 to generate a feedback signal VS1. After being amplified by the gain stage 402, the feedback signal VS1 will have higher noise margin and thereby avoid the influence caused by the line resistance of the power line. In the gain stage 402, a buffer 404 has a non-inverting input connected to the output of the minimum voltage selector 400, a variable resistor RG2 is connected between an inverting input and an output of the buffer 404, a resistor RG1 is connected between the inverting input of the buffer 404 and a node N3, a gain controller 406 controls the resistance of the variable resistor RG2 to control the gain of the gain stage 402, a switch SW1 is connected between a compensation circuit 408 and the node N3, and a switch SW2 is connected between the node N3 and the ground node GND. Referring to FIGS. 3 and 4, since the on-resistance of the transistor 304 in the current source 300 possibly varies with temperature, a temperature variation may induce error in the feedback signal VS1. Therefore, the compensation circuit 408 is preferably employed to eliminate the error. FIG. 5 is a circuit diagram of an embodiment for the buffer 404 shown in FIG. 4. As shown in FIG. 4, all the LED drivers 210 have their feedback pins FB common connected to the feedback input pin FB1 of the DC/DC converter 206, and the buffer 404 has higher sinking capability than sourcing capability as shown in FIG. 5, so that the signal at the feedback input pin FB1 of the DC/DC converter 206 will be the minimum one of the feedback signals VS1 applied to the feedback pins FB and therefore, the DC/DC converter 206 can provide a lower and appropriate supply voltage VLED1 for all the LED light sources 208. Referring to FIG. 4, the DC/DC converter 206 includes an error amplifier 410 to compare the feedback signal received from the feedback input pin FB1 with a reference voltage VREF to generate an error signal for the DC/DC converter 206 to regulate the supply voltage VLED1.

Figure 6:
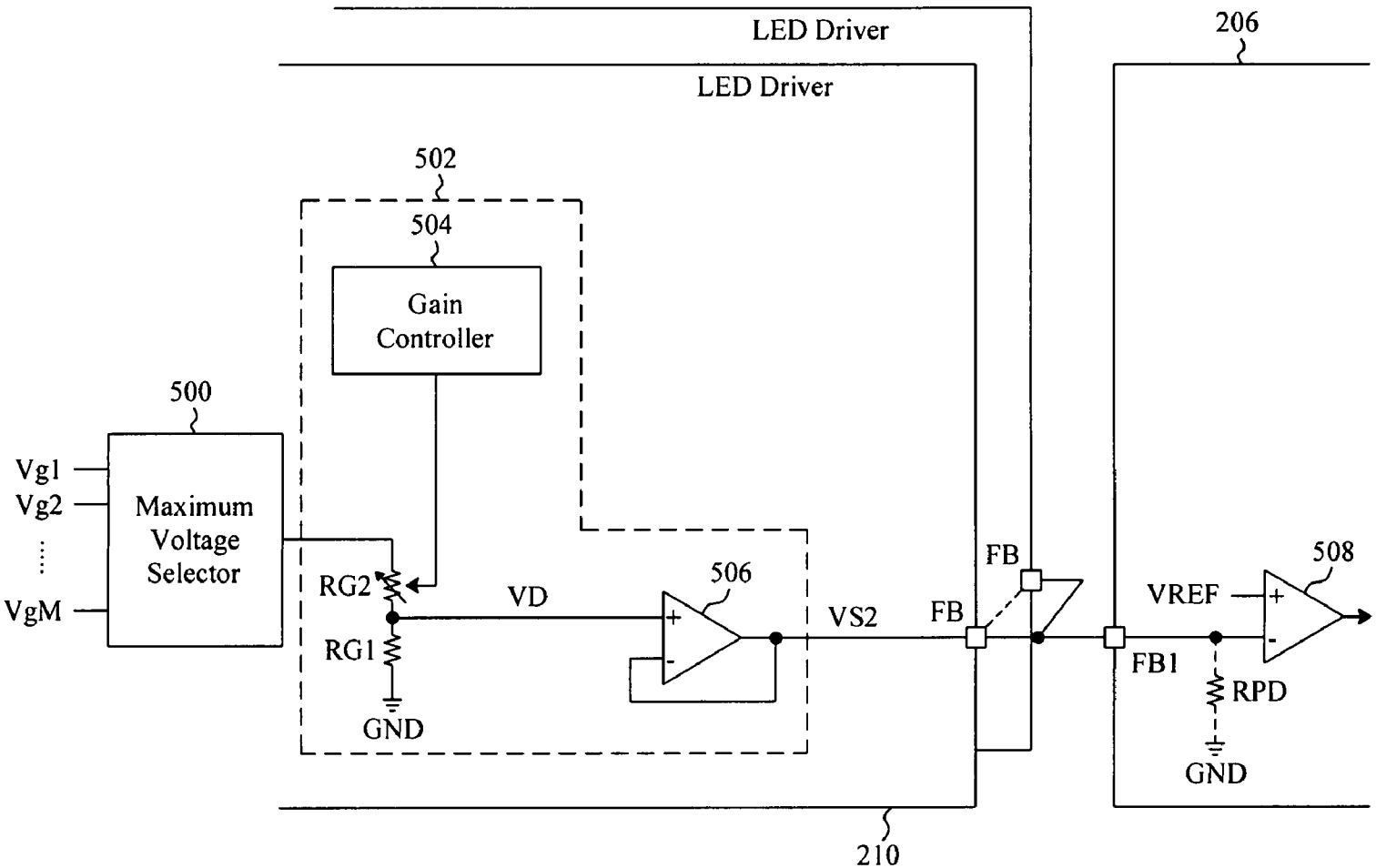
FIG. 6 is a circuit diagram of a second embodiment for the feedback mechanism of the LED driver shown in FIG. 3.
Figure 7:
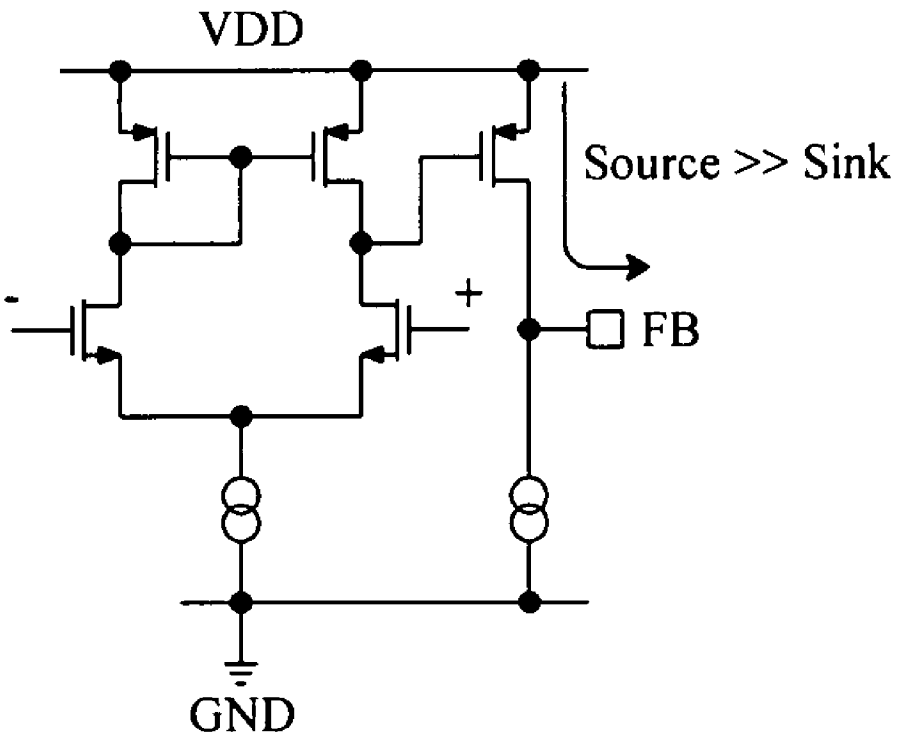
FIG. 7 is a circuit diagram of an embodiment for the buffer shown in FIG. 6.

FIG. 6 is a circuit diagram of a second embodiment for the feedback mechanism of the LED driver 210 shown in FIG. 3, in which a maximum voltage selector 500 monitors the gate voltages Vg1, Vg2, . . . , VgM of all the transistors 304 shown in FIG. 3 and selects the maximum one therefrom to provide for a gain stage 502 to generate a feedback signal VS2. After being amplified by the gain stage 502, the feedback signal VS2 will have higher noise margin and thereby avoid the influence caused by the line resistance of the power line. In the gain stage 502, voltage divider resistors RG1 and RG2 divides the output of the maximum voltage selector 500 to generate a voltage VD, a buffer 506 buffers the voltage VD to generate the feedback signal VS2, and a gain controller 504 controls the resistance of the variable resistor RG2 to control the gain of the gain stage 502. FIG. 7 is a circuit diagram of an embodiment for the buffer 506 shown in FIG. 6. As shown in FIG. 6, all the LED drivers 210 have their feedback pins FB common connected to the feedback input pin FB1 of the DC/DC converter 206, and the buffer 506 has higher sourcing capability than sinking capability as shown in FIG. 7, so that the signal at the feedback input pin FB1 of the DC/DC converter 206 will be the maximum one of the feedback signals VS2 applied to the feedback pins FB. Referring to FIG. 6, the DC/DC converter 206 includes an error amplifier 508 to compare the feedback signal received from the feedback input pin FB1 with a reference voltage VREF to generate an error signal for the DC/DC converter 206 to regulate the supply voltage VLED1.

Figure 8:
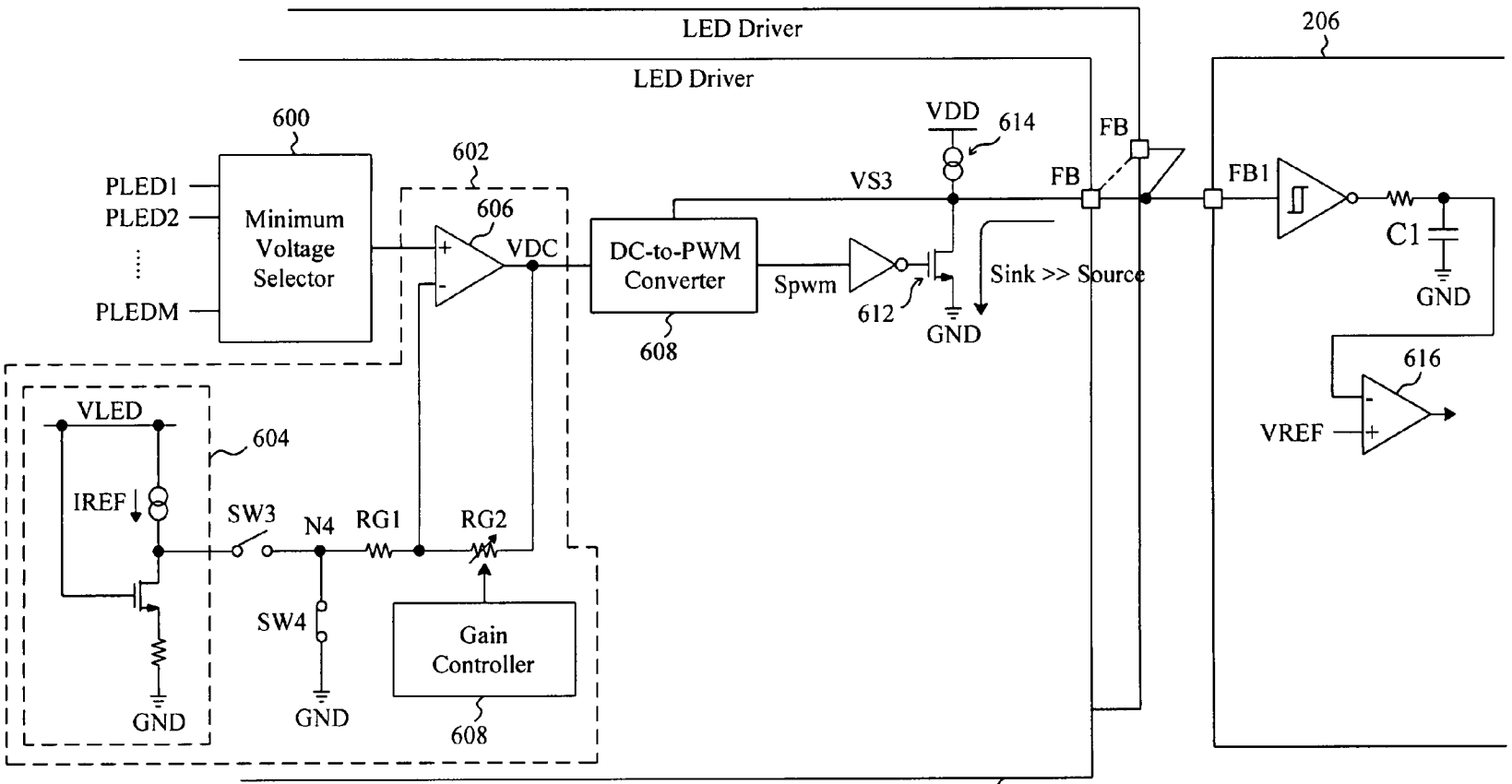
FIG. 8 is a circuit diagram of a third embodiment for the feedback mechanism of the LED driver shown in FIG. 3.
Figure 9:
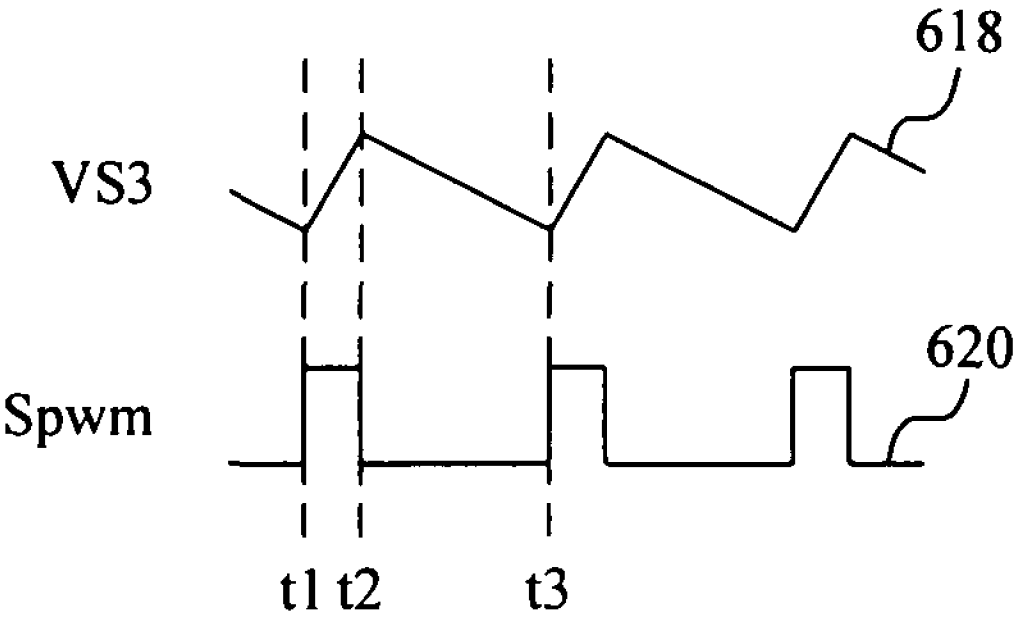
FIG. 9 is a waveform diagram of the circuit of FIG. 8.

FIG. 8 is a circuit diagram of a third embodiment for the feedback mechanism of the LED driver 210 shown in FIG. 3, and FIG. 9 is a waveform diagram of the circuit of FIG. 8. Referring to FIGS. 3 and 8, the LED driver 210 includes a minimum voltage selector 600 to monitor the voltages at the LED pins PLED1-PLEDM and select the minimum one therefrom for a gain stage 602 to generate a DC signal VDC, a DC-to-PWM converter 610 to convert the DC signal VDC to a constant on-time PWM signal Spwm as shown by the waveform 620 of FIG. 9 according to the feedback signal VS3 at the feedback pin FB, and a switch 612 connected between the feedback pin FB and a ground node GND. As shown in FIG. 8, all the LED drivers 210 have their feedback pins FB common connected to the feedback input pin FB1 of the DC/DC converter 206, and the switch 612 connected between the feedback pin FB and the ground node GND has higher sinking capability than sourcing capability, so that the signal at the feedback input pin FB1 of the DC/DC converter 206 will be the minimum one of the feedback signals VS3 applied to the feedback pins FB. Referring to FIGS. 8 and 9, during the on time of the PWM signal Spwm, for example, from time t1 to time t2, the switch 612 is off and therefore, a current source 614 will charge the feedback pin FB so that the feedback signal VS3 will rise as shown by the waveform 618 of FIG. 9. During the off time of the PWM signal Spwm, for example, from time t2 to time t3, the switch 612 is on and therefore, the feedback pin FB is connected to the ground node GND through the switch 612 so that the feedback signal VS3 will go down.

Referring to FIG. 8, in the gain stage 602, a buffer 606 has a non-inverting input connected to the output of the minimum voltage selector 600, a variable resistor RG2 is connected between an inverting input and an output of the buffer 606, a resistor RG1 is connected between the inverting input of the buffer 606 and a node N4, a gain controller 608 controls the resistance of the variable resistor RG2 to control the gain of the gain stage 602, a switch SW3 is connected between a compensation circuit 604 and the node N4, a switch SW4 is connected between the node N4 and the ground node GND, and the compensation circuit 604 eliminates the error caused by temperature variation. In the DC/DC converter 206, an error amplifier 616 compares the feedback signal received from the feedback input pin FB1 with a reference voltage VREF to generate an error signal for the DC/DC converter 206 to regulate the supply voltage VLED1.

Figure 10:
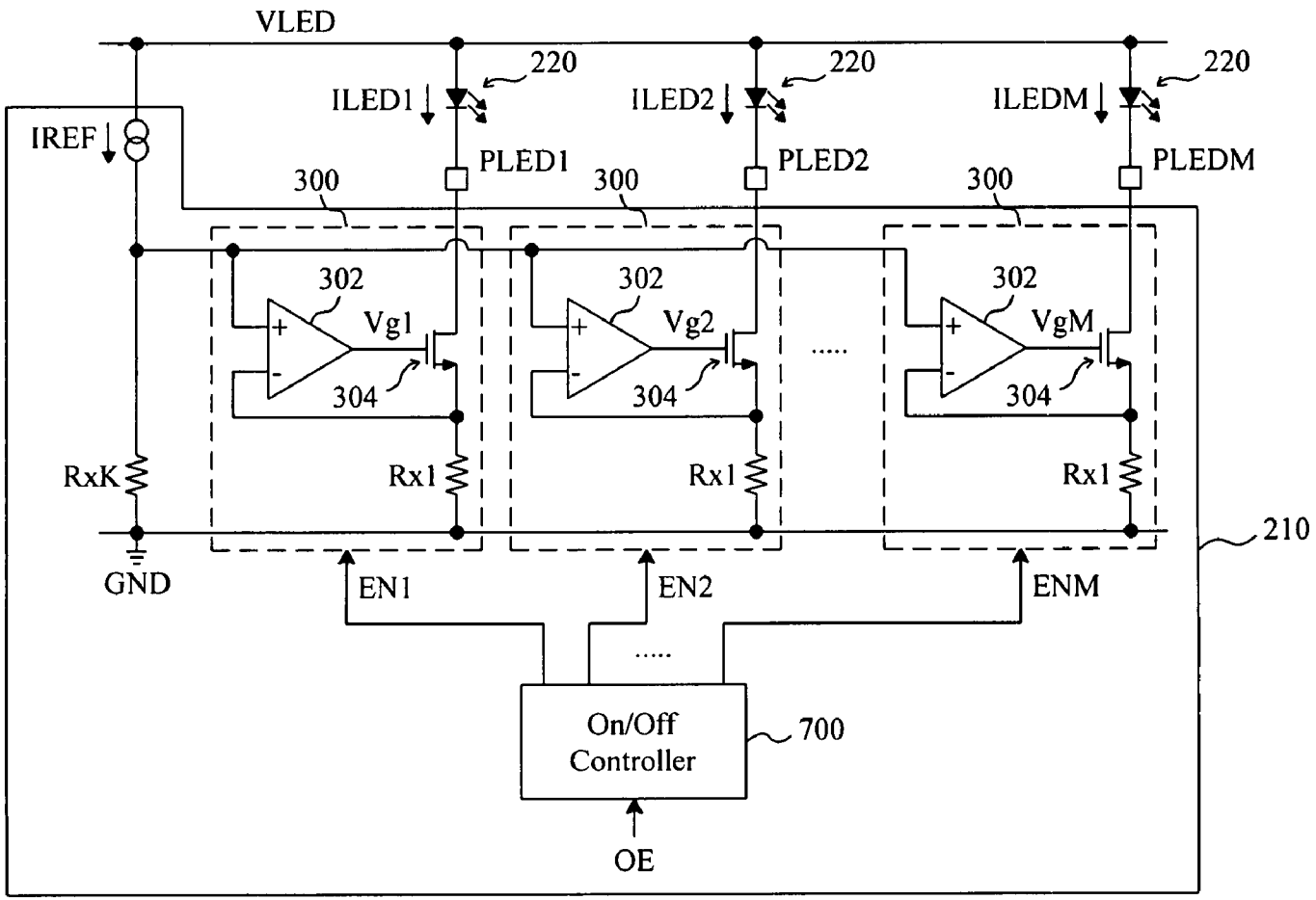
FIG. 10 is a circuit diagram of a second embodiment for the LED driver of FIG. 2.
Figure 11:
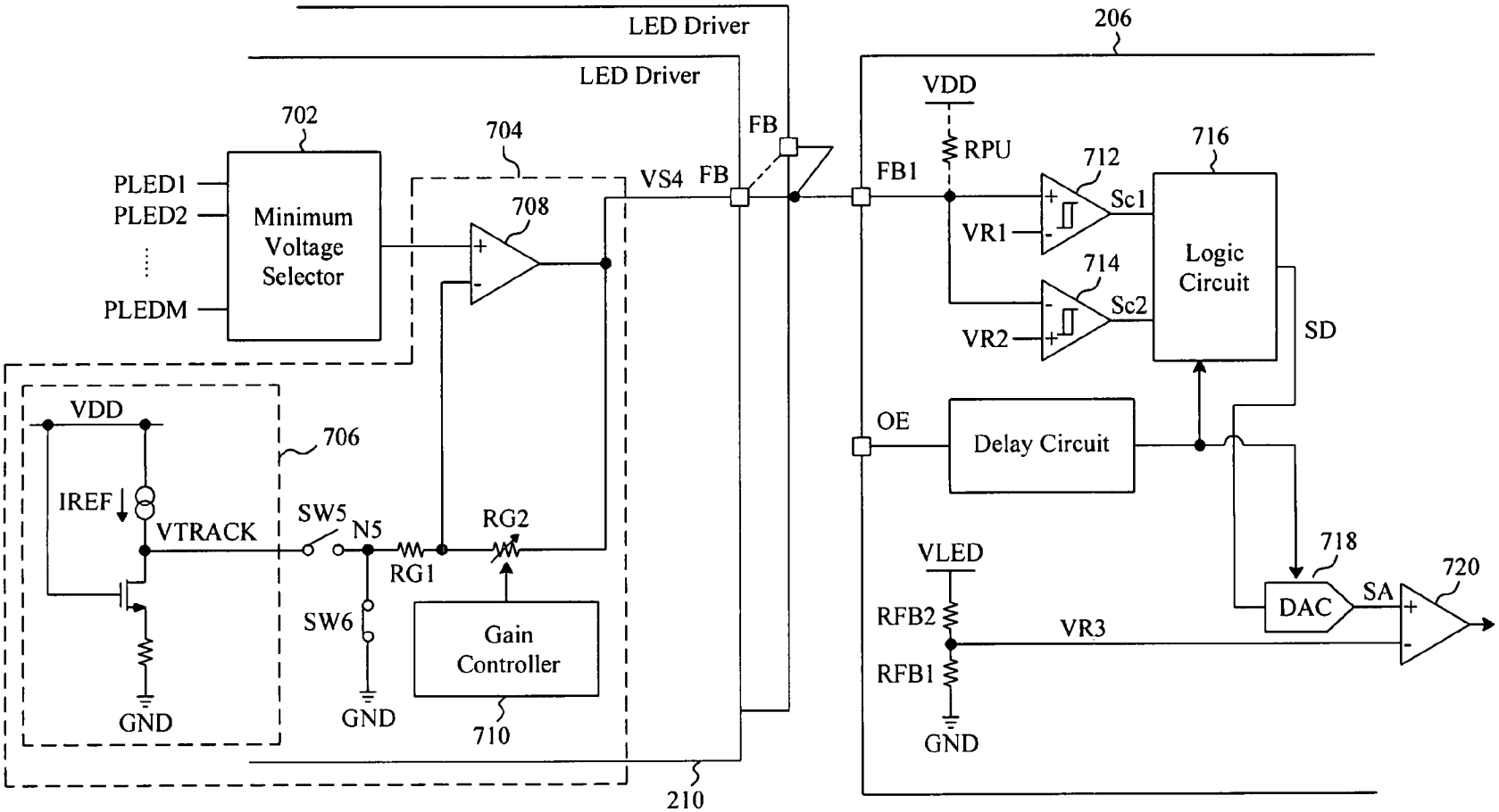
FIG. 11 is a circuit diagram of a second embodiment for the feedback mechanism of the LED driver shown in FIG. 10.

FIG. 10 is a circuit diagram of a second embodiment for the LED driver 210 of FIG. 2, which also includes multiple current sources 300 to drive multiple LEDs 220 respectively, and an on/off controller 700 provides control signals EN1, EN2, . . . , ENM according to an output enable signal received from an output enable pin OE, to individually determine to enable each respective one of the current sources 300. FIG. 11 is a circuit diagram of an embodiment for the feedback mechanism of the LED driver 210 shown in FIG. 10, in which a minimum voltage sampler 702 samples the minimum one of the voltages at the LED pins PLED1-PLEDM to provide for a gain stage 704 to generate a feedback signal VS4 applied to the feedback pin FB. After being amplified by the gain stage 704, the feedback signal VS4 will have higher noise margin and thereby avoid the influence caused by the line resistance of the power line. In the gain stage 704, a buffer 708 has a non-inverting input connected to the output of the minimum voltage sampler 702, a variable resistor RG2 is connected between an inverting input and an output of the buffer 708, a resistor RG1 is connected between the inverting input of the buffer 708 and a node N5, a switch SW5 is connected between a compensation circuit 706 and a node N5, a switch SW6 is connected between the node N5 and a ground node GND, and, a gain controller 710 controls the resistance of the variable resistor RG2 to control the gain of the gain stage 704.

As shown in FIG. 11, all the LED drivers 210 have their feedback pins FB common connected to the feedback input pin FB1 of the DC/DC converter 206, and the buffer 708 has higher sinking capability than sourcing capability, so that the signal at the feedback input pin FB1 of the DC/DC converter 206 will be the minimum one of the feedback signals VS4 applied to the feedback pins FB. The buffer 708 has the same circuit as that of FIG. 5. In the DC/DC converter 206, a hysteretic comparator 712 compares the signal received from the feedback pin FB1 with a reference voltage VR1 to generate a comparison signal Sc1, a hysteretic comparator 714 compares the signal received from the feedback pin FB1 with a reference voltage VR2 to generate a comparison signal Sc2, a logic circuit 716 generates a digital signal SD according to the comparison signals Sc1 and Sc2, a digital-to-analog converter (DAC) 718 converts the digital signal SD to an analog signal SA, and an error amplifier 720 compares the analog signal SA with a reference voltage VR3 to generate an error signal for the DC/DC converter 206 to regulate the supply voltage VLED1. In another embodiment, the error amplifier 720 may directly compare the signal received from the feedback input pin FB1 with the reference voltage VR3 to generate the error signal for the DC/DC converter 206 to regulate the supply voltage VLED1.

Although the above embodiments only illustrate the LED driver 210 in detail, any one skilled in the art may implement the LED drivers 214 and 218 in the same manner.

Figure 12:
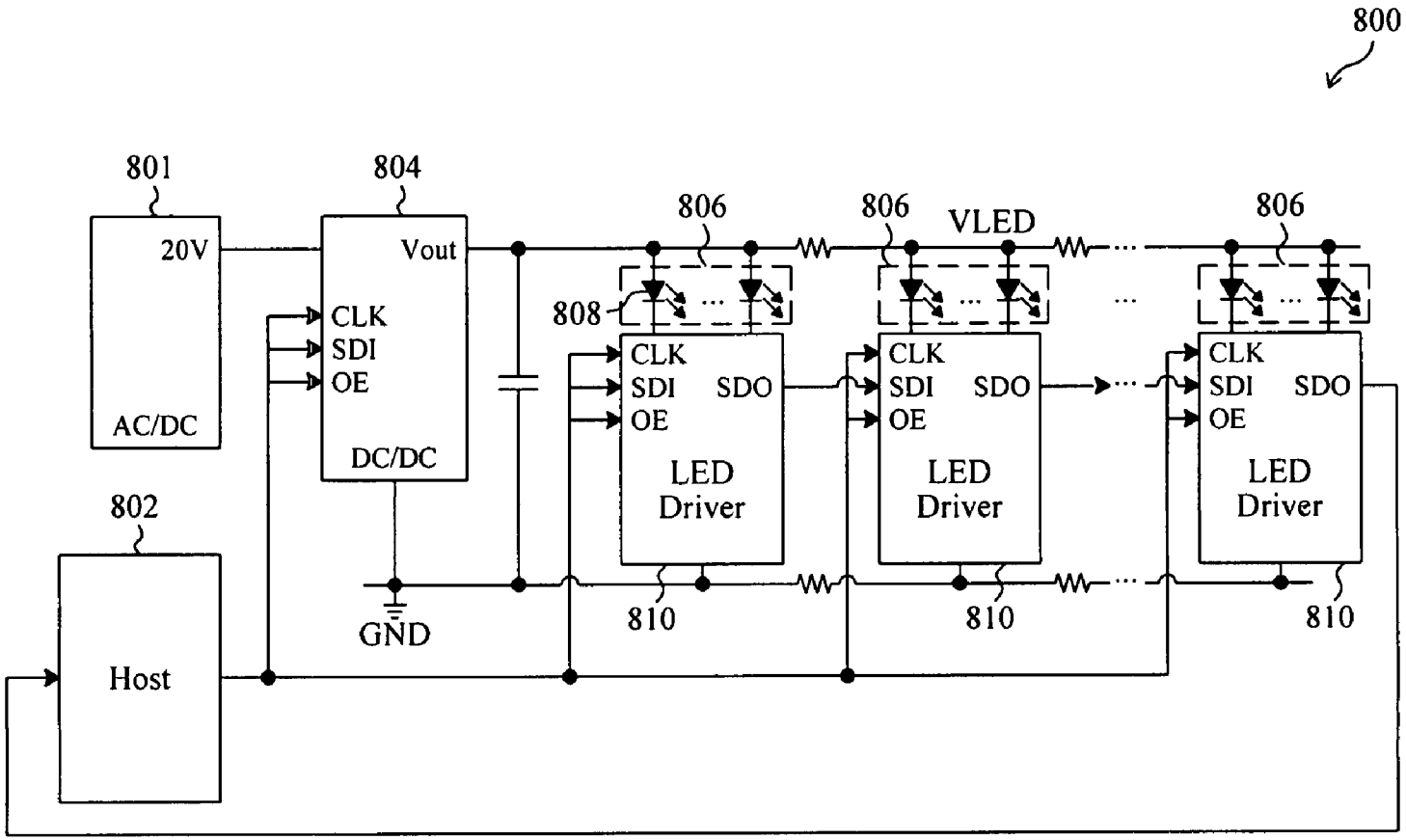
FIG. 12 is a systematic diagram of another LED display system according to the present invention.

FIG. 12 is a systematic diagram of another LED display system 800 according to the present invention, in which an AC/DC converter 801 converts an AC voltage to a DC high voltage of 20V, a host 802 provides a data clock, a data signal and an output enable signal to the data clock input pin CLK, data input pin SDI and output enable pin OE of a DC/DC converter 804, the DC/DC converter 804 converts the DC high voltage to a DC low voltage VLED for multiple LED light sources 806, each LED light source 806 includes multiple parallel connected LEDs 808, and multiple LED drivers 810 drive the LED light sources 806 respectively. Among the LED drivers 810, the first one provides a data signal according to the data clock, data signal and output enable signal from the host 802, through a data output pin SDO to a data input pin SDI of the next LED driver 810, each of the other LED drivers 810 provides a data signal according to the data clock and output enable signal from the host 802 and the data signal from the previous LED driver 810 for its next LED driver 810, and the last LED driver 810 provides a data signal fed back to the host 802. The host 802 signals the DC/DC converter 804 according to the feedback data signal to regulate the supply voltage VLED to be slightly higher than the forward voltages of the LEDs 808. Therefore, there is no need of heat sinker resistors, the efficiency is improved and the total component cost is reduced.

Figure 13:
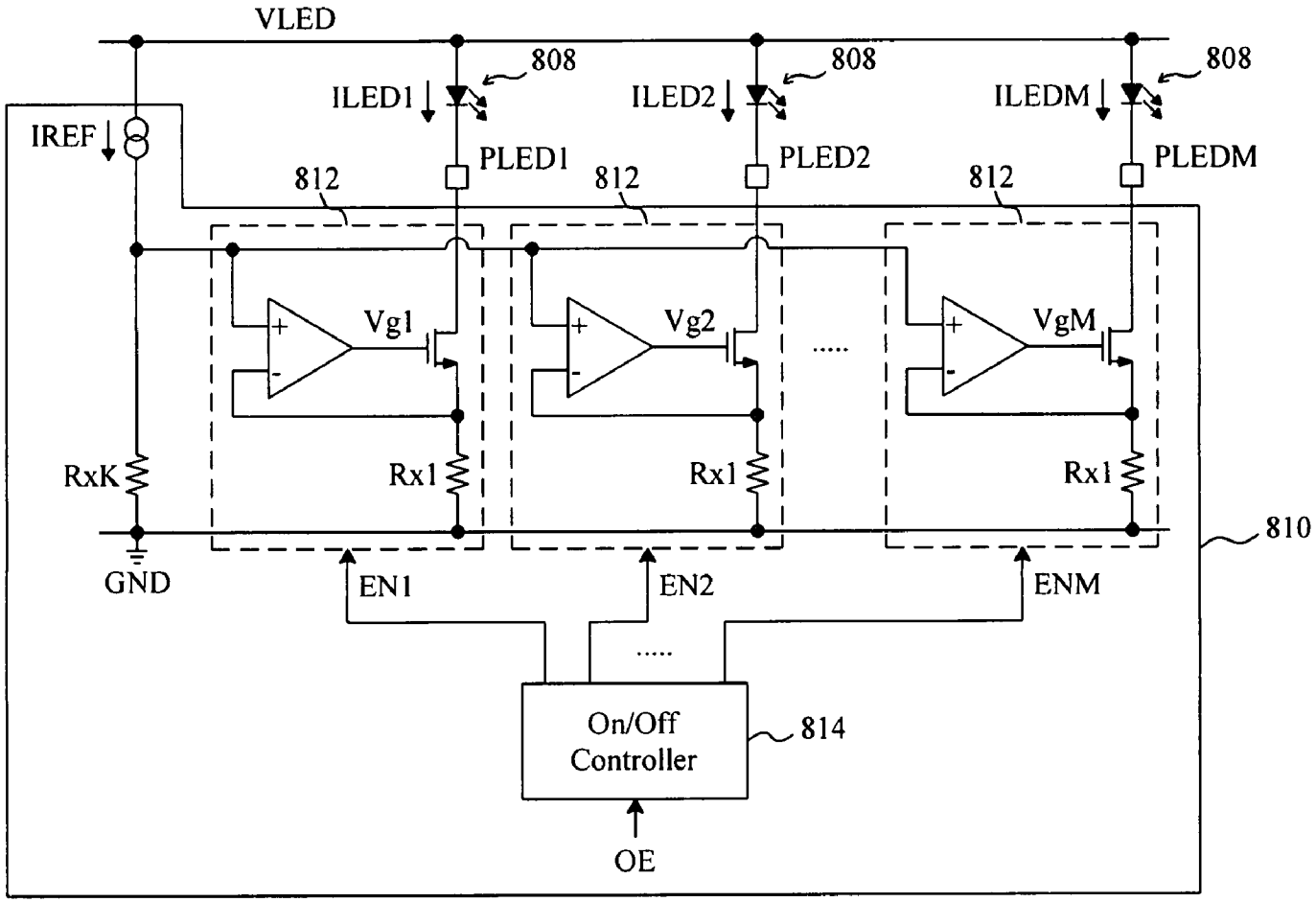
FIG. 13 is a circuit diagram of a portion of the LED driver shown in FIG. 12.
Figure 14:
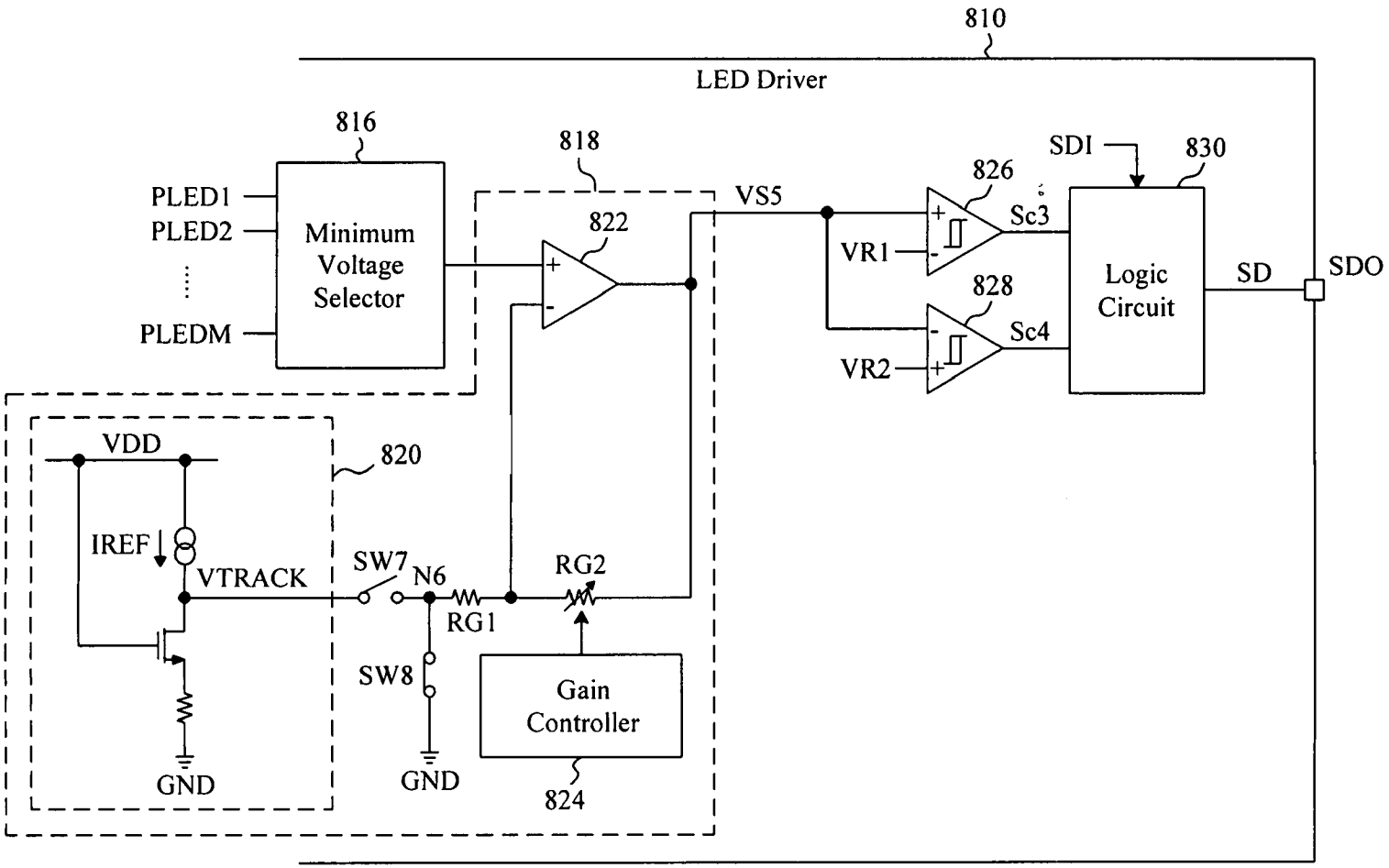
FIG. 14 is a circuit diagram of another portion of the LED driver other than that of FIG. 13.

FIG. 13 is a circuit diagram of a portion of the LED driver 810 shown in FIG. 12, in which each of LED pins PLED1, PLED2, . . . , PLEDM is connected to a respective LED 808, each of current sources 812 is connected to a respective one of the LED pins PLED1-PLEDM to drive the LED 808 connected thereto, an on/off controller 814 generates control signals EN1, EN2, . . . , ENM according to the output enable signal received from the output enable pin OE, to individually determine to enable each respective one of the current sources 812. FIG. 14 is a circuit diagram of another portion of the LED driver 810 other than that of FIG. 13. Taking the first LED driver 810 for example, it includes a minimum voltage sampler 816 to sample the minimum one of the voltages at the LED pins PLED1-PLEDM for a gain stage 818 to generate a signal VS5, a hysteretic comparator 826 to compare the signal VS5 with a reference voltage VR1 to generate a comparison signal Sc3, a hysteretic comparator 828 to compare the signal VS5 with a reference voltage VR2 to generate a comparison signal Sc4, and a logic circuit 830 to generate a digital signal SD according to the signal received from the data input pin SDI and the comparison signals Sc3 and Sc4 to provide for the next LED driver 810 through the data output pin SDO. The signal SD is a digital signal and thus can avoid the influence of noise caused by the line resistance of the power line.

In the gain stage 818, a buffer 822 has a non-inverting input connected to the output of the minimum voltage sampler 816, a variable resistor RG2 is connected between the output and an inverting input of the buffer 822, a resistor RG1 is connected between the inverting input of the buffer 822 and a node N6, a switch SW5 is connected between a compensation circuit 820 and the node N6, a switch SW6 is connected between the node N6 and the ground node GND, and a gain controller 824 controls the resistance of the variable resistor RG2 to control the gain of the gain stage 818.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A LED display system, comprising:

a plurality of LEDs;

a plurality of drivers for driving the plurality of LEDs, each of the plurality of drivers having a plurality of LED pins and a feedback pin to provide a feedback signal, each of the plurality of LED pins connected to a respective one of the plurality of LEDs; and a power converter connected to the plurality of LEDs and the plurality of drivers to convert a DC high voltage to at least a DC low voltage for the plurality of LEDs, and regulate the at least a DC low voltage according to one of the plurality of feedback signals.

2. The LED display system of claim 1, further comprising a second power converter connected to the first power converter to convert an AC voltage to the DC high voltage.

3. The LED display system of claim 1, wherein the at least a DC low voltage comprises two different DC low voltages provided for tow groups of the LEDs.

4. The LED display system of claim 1, wherein each of the plurality of drivers further comprises:

a minimum voltage selector connected to the plurality of LED pins to select the minimum one of the voltages at the plurality of LED pins; and a gain stage connected to the minimum voltage selector to generate the feedback signal according to the minimum voltage.

5. The LED display system of claim 4, wherein the gain stage comprises a compensation circuit to compensate the feedback signal to eliminate an error in the feedback signal caused by a temperature variation.

6. The LED display system of claim 4, wherein the gain stage comprises a gain controller to control a gain of the gain stage.

7. The LED display system of claim 1, wherein each of the plurality of drivers further comprises a plurality of current sources, each of the plurality of current sources connected to a respective one of the plurality of LED pins of this driver to control a driving current in the LED connected to the LED pin it is connected.

8. The LED display system of claim 7, wherein each of the plurality of current sources comprises:

a resistor;

a transistor connected between the resistor and the LED pin it is connected; and an operational amplifier having a first input connected to a voltage node, a second input connected to the node between the resistor and transistor, and an output connected to a gate of the transistor.

9. The LED display system of claim 8, wherein each of the plurality of drivers further comprises:

a maximum voltage selector connected to the gates of all the transistors in the plurality of current sources of the driver to select the maximum one of the gate voltages; and a gain stage connected to the maximum voltage selector to generate the feedback signal according to the maximum gate voltage.

10. The LED display system of claim 9, wherein the gain stage comprises a gain controller to control a gain of the gain stage.

11. The LED display system of claim 1, wherein each of the plurality of drivers further comprises:

a minimum voltage selector connected to the plurality of LED pins to select the minimum one of the voltages at the plurality of LED pins;

a gain stage connected to the minimum voltage selector to generate a DC signal according to the minimum voltage;

a current source connected to the feedback pin;

a switch connected between the feedback pin and a ground node; and a DC-to-PWM converter connected to the gain stage to convert the DC signal to a PWM signal according to the signal at feedback pin to switch the switch to regulate the feedback signal.

12. The LED display system of claim 11, wherein the gain stage comprises a compensation circuit to compensate the feedback signal to eliminate an error in the feedback signal caused by a temperature variation.

13. The LED display system of claim 11, wherein the gain stage comprises a gain controller to control a gain of the gain stage.

14. The LED display system of claim 1, wherein each of the plurality of drivers further comprises:

a minimum voltage sampler connected to the plurality of LED pins to sample the minimum one of the voltages at the plurality of LED pins; and a gain stage connected to the minimum voltage sampler to generate the feedback signal according to the minimum voltage.

15. The LED display system of claim 14, wherein the gain stage comprises a compensation circuit to compensate the feedback signal to eliminate an error in the feedback signal caused by a temperature variation.

16. The LED display system of claim 14, wherein the gain stage comprises a gain controller to control a gain of the gain stage.

17. The LED display system of claim 14, wherein the power converter comprises:

a first hysteretic comparator connected to the plurality of drivers to compare the one of the plurality of feedback signals with a first reference voltage to generate a first comparison signal;

a second hysteretic comparator connected to the plurality of drivers to compare the one of the plurality of feedback signals with a second reference voltage to generate a second comparison signal;

a logic circuit connected to the first and second hysteretic comparators to generate a digital signal according to the first and second comparison signals;

a digital-to-analog converter connected to the logic circuit to convert the digital signal to an analog signal; and an error amplifier connected to the digital-to-analog converter to amplify a difference between the analog signal and a third reference voltage to generate an error signal to regulate the DC low voltage.

18. A LED display system, comprising:

a plurality of LEDs;

a power converter connected to the plurality of LEDs to convert a DC high voltage to at least a DC low voltage for the plurality of LED; and a plurality of drivers for driving the plurality of LEDs, each of the plurality of drivers having a plurality of LED pins, each of the plurality of LED pins connected to a respective one of the plurality of LEDs;

wherein each of the plurality of drivers receives a first digital signal and provides a second digital signal as the first digital signal of the next driver, and the second digital signal of the last one of the plurality of drivers is used for the power converter to regulate the at least a DC low voltage.

19. The LED display system of claim 18, further comprising a second power converter connected to the first power converter to convert an AC voltage to the DC high voltage.

20. The LED display system of claim 18, wherein each of the plurality of drivers further comprises:

a minimum voltage sampler connected to the plurality of LED pins to sample the minimum one of the voltages at the plurality of LED pins; and a gain stage connected to the minimum voltage sampler to generate a first signal according to the minimum voltage;

a first hysteretic comparator connected to the gain stage to compare the first signal with a first reference voltage to generate a second signal;

a second hysteretic comparator connected to the gain stage to compare the first signal with a second reference voltage to generate a third signal; and a logic circuit connected to the first and second hysteretic comparators to generate a second digital signal according to the second and third comparison signals and the first digital signal.

21. The LED display system of claim 20, wherein the gain stage comprises a compensation circuit to compensate the first signal to eliminate an error in the first signal caused by a temperature variation.

22. The LED display system of claim 20, wherein the gain stage comprises a gain controller to control a gain of the gain stage.

23. A driver for a LED display system including a power converter to provide a supply voltage for a plurality of LEDs, the driver comprising:

a plurality of LED pins, each of which connected to a respective one of the plurality of LEDs;

a feedback pin to provide a feedback signal for the power converter to regulate the supply voltage;

a minimum voltage selector connected to the plurality of LED pins to select the minimum one of the voltages at the plurality of LED pins; and a gain stage connected to the minimum voltage selector to generate the feedback signal according to the minimum voltage.

24. The driver of claim 23, wherein the gain stage comprises a compensation circuit to compensate the feedback signal to eliminate an error in the feedback signal caused by a temperature variation.

25. The driver of claim 23, wherein the gain stage comprises a gain controller to control a gain of the gain stage.

26. A driver for a LED display system including a power converter to provide a supply voltage for a plurality of LEDs, the driver comprising:

a plurality of LED pins, each of which connected to a respective one of the plurality of LEDs;

a feedback pin to provide a feedback signal for the power converter to regulate the supply voltage;

a plurality of current sources, each of which connected to a respective one of the plurality of LED pins to control a driving current in the LED connected to the LED pin, each of the plurality of current sources comprising:

a resistor;

a transistor connected between the resistor and the LED pin; and an operational amplifier having a first input connected to a voltage node, a second input connected to the node between the resistor and transistor, and an output connected to a gate of the transistor;

a maximum voltage selector connected to the gates of all the transistors in the plurality of current sources to select the maximum one of the gate voltages; and a gain stage connected to the maximum voltage selector to generate the feedback signal according to the maximum gate voltage.

27. The driver of claim 26, wherein the gain stage comprises a gain controller to control a gain of the gain stage.

28. A driver for a LED display system including a power converter to provide a supply voltage for a plurality of LEDs, the driver comprising:

a plurality of LED pins, each of which connected to a respective one of the plurality of LEDs;

a feedback pin to provide a feedback signal for the power converter to regulate the supply voltage;

a minimum voltage selector connected to the plurality of LED pins to select the minimum one of the voltages at the plurality of LED pins;

a gain stage connected to the minimum voltage selector to generate a DC signal according to the minimum voltage;

a current source connected to the feedback pin;

a switch connected between the feedback pin and a ground node; and a DC-to-PWM converter connected to the gain stage to convert the DC signal to a PWM signal according to the signal at feedback pin to switch the switch to regulate the feedback signal.

29. The driver of claim 28, wherein the gain stage comprises a compensation circuit to compensate the feedback signal to eliminate an error in the feedback signal caused by a temperature variation.

30. The driver of claim 28, wherein the gain stage comprises a gain controller to control a gain of the gain stage.

31. A driver for a LED display system including a power converter to provide a supply voltage for a plurality of LEDs, the driver comprising:

a plurality of LED pins, each of which connected to a respective one of the plurality of LEDs;

a feedback pin to provide a feedback signal for the power converter to regulate the supply voltage;

a minimum voltage sampler connected to the plurality of LED pins to sample the minimum one of the voltages at the plurality of LED pins; and a gain stage connected to the minimum voltage sampler to generate the feedback signal according to the minimum voltage.

32. The driver of claim 31, wherein the gain stage comprises a compensation circuit to compensate the feedback signal to eliminate an error in the feedback signal caused by a temperature variation.

33. The driver of claim 31, the gain stage comprises a gain controller to control a gain of the gain stage.

34. A driver for a LED display system including a power converter to provide a supply voltage for a plurality of LEDs, the driver comprising:

a plurality of LED pins, each of which connected to a respective one of the plurality of LEDs;

a minimum voltage sampler connected to the plurality of LED pins to sample the minimum one of the voltages at the plurality of LED pins;

a gain stage connected to the minimum voltage sampler to generate a first signal according to the minimum voltage;

a first hysteretic comparator connected to the gain stage to compare the first signal with a first reference voltage to generate a second signal;

a second hysteretic comparator connected to the gain stage to compare the first signal with a second reference voltage to generate a third signal; and a logic circuit connected to the first and second hysteretic comparators to generate a digital output signal according to the second and third signal and a digital input signal.

35. The driver of claim 34, wherein the gain stage comprises a compensation circuit to compensate the first signal to eliminate an error in the first signal caused by a temperature variation.

36. The driver of claim 34, wherein the gain stage comprises a gain controller to control a gain of the gain stage.

37. A control method for a LED display system including a plurality of LEDs and a plurality of drivers, each of the plurality of drivers having a plurality of LED pins, each of the plurality of LED pins connected to a respective one of the plurality of LEDs, the control method comprising:

converting a DC high voltage to at least a DC low voltage for the plurality of LEDs;

monitoring the voltages at the plurality of LED pins; and regulating the at least a DC low voltage according to one of the voltages at the plurality of LED pins.

38. The control method of claim 37, wherein the DC high voltage is converted from an AC voltage.

39. The control method of claim 37, wherein the step of regulating the at least a DC low voltage according to one of the voltages at the plurality of LED pins comprises:

selecting the minimum one of the voltages at the plurality of LED pins; and amplifying the minimum voltage with a gain to generate a feedback signal to regulate the at least a DC low voltage.

40. The control method of claim 39, further comprising compensating the feedback signal to eliminate an error in the feedback signal caused by a temperature variation.

41. The control method of claim 39, further comprising controlling the gain.

42. The control method of claim 37, wherein the step of regulating the at least a DC low voltage according to one of the voltages at the plurality of LED pins comprises:

selecting the minimum one of the voltages at the plurality of LED pins;

amplifying the minimum voltage with a gain to generate a first signal;

generating a second signal according to a feedback signal at a feedback pin and the first signal; and charging and discharging the feedback pin according to the second signal to generate the feedback signal to regulate the at least a DC low voltage.

43. The control method of claim 42, further comprising compensating the feedback signal to eliminate an error in the feedback signal caused by a temperature variation.

44. The control method of claim 42, further comprising controlling the gain.

45. The control method of claim 37, wherein the step of regulating the at least a DC low voltage according to one of the voltages at the plurality of LED pins comprises:

sampling the minimum one of the voltages at the plurality of LED pins; and amplifying the minimum voltage with a gain to generate a feedback signal to regulate the at least a DC low voltage.

46. The control method of claim 45, further comprising compensating the feedback signal to eliminate an error in the feedback signal caused by a temperature variation.

47. The control method of claim 45, further comprising controlling the gain.

48. A control method for a LED display system including a plurality of LEDs and a plurality of drivers, each of the plurality of drivers having a plurality of LED pins and a plurality of current sources, each of the plurality of current sources having a resistor, a transistor connected between the resistor and the LED pin it is connected, and an operational amplifier having a first input connected to a voltage node, a second input connected to the node between the resistor and transistor, and an output connected to a gate of the transistor, the control method comprising:

converting a DC high voltage to at least a DC low voltage for the plurality of LEDs;

monitoring the gate voltages of the plurality of transistors; and regulating the at least a DC low voltage according to one of the gate voltages of the plurality of transistors.

49. The control method of claim 48, wherein the DC high voltage is converted from an AC voltage.

50. The control method of claim 48, wherein the step of regulating the at least a DC low voltage according to one of the gate voltages of the plurality of transistors comprises:

selecting the maximum one of the gate voltages of the plurality of transistors; and amplifying the maximum voltage with a gain to generate a feedback signal to regulate the at least a DC low voltage.

51. The control method of claim 48, further comprising controlling the gain.

52. A control method for a LED display system including a plurality of LEDs and a plurality of drivers, each of the plurality of drivers having a plurality of LED pins, each of the plurality of LED pins connected to a respective one of the plurality of LEDs, the control method comprising:

converting a DC high voltage to at least a DC low voltage for the plurality of LEDs;

in each of the plurality of drivers, according to the minimum one of the voltages at the plurality of LED pins thereof and a first digital signal, generating a second digital signal as the first digital signal of the next driver; and regulating the at least a DC low voltage according to the second digital signal of the last one of the plurality of drivers.

53. The control method of claim 52, wherein the DC high voltage is converted from an AC voltage.

54. The control method of claim 52, wherein the step of generating a second digital signal as the first digital signal of the next driver comprises:

monitoring the voltages at the plurality of LED pins;

sampling the minimum one of the voltages at the plurality of LED pins;

amplifying the minimum voltage with a gain to generate a first signal;

comparing the first signal with a first reference voltage to generate a second signal;

comparing the first signal with a second reference voltage to generate a third signal; and generating the second digital signal according to the second and third signals and a first digital signal.

55. A control method for a driver in a LED display system including a plurality of LEDs and a power converter to provide a supply voltage for the plurality of LEDs, the driver having a plurality of LED pins, each of the plurality of LED pins connected to a respective one of the plurality of LEDs, the control method comprising:

selecting the minimum one of the voltages at the plurality of LED pins; and amplifying the minimum voltage with a gain to generate a feedback signal to regulate the supply voltage.

56. The control method of claim 55, further comprising compensating the feedback signal to eliminate an error in the feedback signal caused by a temperature variation.

57. The control method of claim 55, further comprising controlling the gain.

58. A control method for a driver in a LED display system including a plurality of LEDs and a power converter to provide a supply voltage for the plurality of LEDs, the driver having a plurality of LED pins and a plurality of current sources, each of the plurality of LED pins connected to a respective one of the plurality of LEDs, each of the plurality of current sources having a resistor, a transistor connected between the resistor and the LED pin it is connected, and an operational amplifier having a first input connected to a voltage node, a second input connected to the node between the resistor and transistor, and an output connected to a gate of the transistor, the control method comprising:

selecting the maximum one of the gate voltages of the plurality of transistors; and amplifying the maximum voltage with a gain to generate a feedback signal to regulate the at least a DC low voltage.

59. The control method of claim 58, further comprising controlling the gain.

60. A control method for a driver in a LED display system including a plurality of LEDs and a power converter to provide a supply voltage for the plurality of LEDs, the driver having a plurality of LED pins, each of the plurality of LED pins connected to a respective one of the plurality of LEDs, the control method comprising:

selecting the minimum one of the voltages at the plurality of LED pins;

amplifying the minimum voltage with a gain to generate a first signal;

generating a second signal according to a feedback signal at a feedback pin and the first signal; and charging and discharging the feedback pin according to the second signal to generate the feedback signal to regulate the at least a DC low voltage.

61. The control method of claim 60, further comprising compensating the feedback signal to eliminate an error in the feedback signal caused by a temperature variation.

62. The control method of claim 60, further comprising controlling the gain.

63. A control method for a driver in a LED display system including a plurality of LEDs and a power converter to provide a supply voltage for the plurality of LEDs, the driver having a plurality of LED pins, each of the plurality of LED pins connected to a respective one of the plurality of LEDs, the control method comprising:

sampling the minimum one of the voltages at the plurality of LED pins; and amplifying the minimum voltage with a gain to generate a feedback signal to regulate the supply voltage.

64. The control method of claim 63, further comprising compensating the feedback signal to eliminate an error in the feedback signal caused by a temperature variation.

65. The control method of claim 63, further comprising controlling the gain.

66. A control method for a driver in a LED display system including a plurality of LEDs and a power converter to provide a supply voltage for the plurality of LEDs, the driver having a plurality of LED pins, each of the plurality of LED pins connected to a respective one of the plurality of LEDs, the control method comprising:

sampling the minimum one of the voltages at the plurality of LED pins;

amplifying the minimum voltage with a gain to generate a first signal;

comparing the first signal with a first reference voltage to generate a second signal;

comparing the first signal with a second reference voltage to generate a third signal; and generating a digital output signal according to the second and third signals and a digital input signal.

67. The control method of claim 66, further comprising compensating the first signal to eliminate an error in the first signal caused by a temperature variation.

68. The control method of claim 66, further comprising controlling the gain.

* * * * *